US008265515B2

(12) United States Patent
Ishii et al.

(10) Patent No.: US 8,265,515 B2
(45) Date of Patent: Sep. 11, 2012

(54) PROCESS CARTRIDGE INCLUDING CLEANING MEMBER FOR CLEANING CHARGING WIRE

(75) Inventors: Masahiro Ishii, Nagoya (JP); Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 443 days.

(21) Appl. No.: 12/604,868

(22) Filed: Oct. 23, 2009

(65) Prior Publication Data

US 2010/0119252 A1 May 13, 2010

(30) Foreign Application Priority Data

Nov. 10, 2008 (JP) ..... 2008-287434

(51) Int. Cl.
*G03G 15/02* (2006.01)
*G03G 21/16* (2006.01)

(52) U.S. Cl. ..... 399/100; 399/111

(58) Field of Classification Search ..... 399/100, 399/111; 250/324–326
See application file for complete search history.

(56) References Cited

U.S. PATENT DOCUMENTS

| | | | | |
|---|---|---|---|---|
| 4,764,675 | A * | 8/1988 | Levy et al. | 250/324 |
| 5,940,656 | A * | 8/1999 | Hensel | 399/100 |
| 6,163,664 | A | 12/2000 | Hayashi | |
| 7,079,786 | B2 * | 7/2006 | Tanaka | 399/100 |
| 7,761,027 | B2 | 7/2010 | Takami | |
| 2006/0140664 | A1 | 6/2006 | Takami | |

FOREIGN PATENT DOCUMENTS

| | | |
|---|---|---|
| JP | 02-075669 | 6/1990 |
| JP | H2-75669 U | 6/1990 |
| JP | 07-295404 A | 11/1995 |
| JP | 10-020626 A | 1/1998 |
| JP | 11-242374 A | 9/1999 |
| JP | 2000-227700 A | 8/2000 |
| JP | 2006-145589 A | 6/2006 |
| JP | 2006-184316 A | 7/2006 |
| JP | 2007-017851 | 1/2007 |
| JP | 2007-017852 | 1/2007 |
| JP | 2007-127901 | 5/2007 |

OTHER PUBLICATIONS

JP Office Action dated Sep. 13, 2011, corresponding JP Application No. 2010-239317; English Translation.

* cited by examiner

*Primary Examiner* — Susan Lee
(74) *Attorney, Agent, or Firm* — Banner & Witcoff, Ltd.

(57) ABSTRACT

A process cartridge includes a charging wire for charging a photosensitive member and a cleaning member for cleaning the charging wire. When the cleaning member moves from a first position to a second position while sliding on the charging wire, a moving member in a third position is moved to a fourth position. However, the moving member remains in the fourth position when the cleaning member moves from the second position to the first position.

19 Claims, 11 Drawing Sheets

LEFT←→RIGHT 99L
99
995
92
96
97
992
996
997
996
994
993
99R
94

99
995
96
992
996
997
996

99
995
96
992
996
997
996
994

99
995
96
992
996
997
996

99
995
96
992
996
997
996

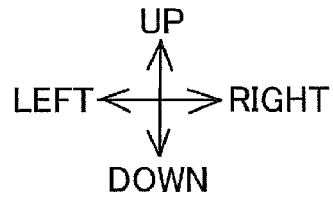
FIG. 9(a)
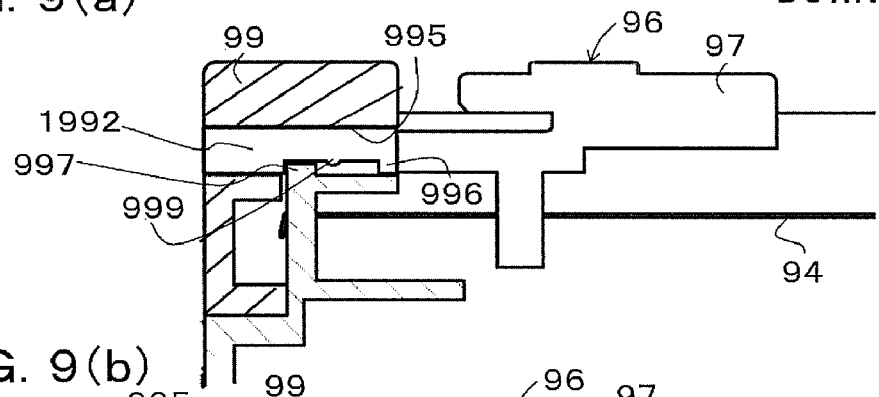
FIG. 9(b)
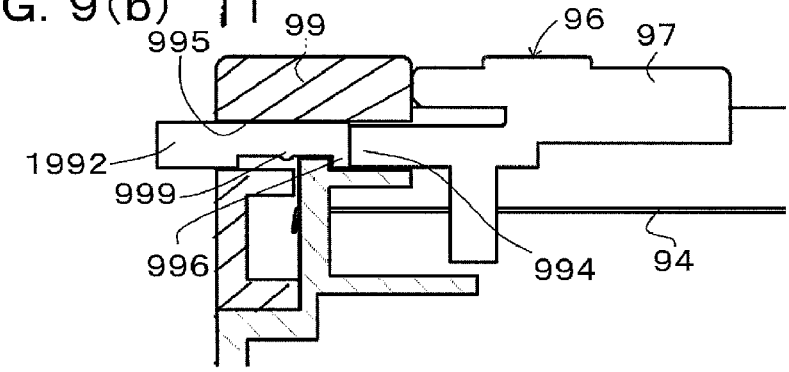
FIG. 9(c)
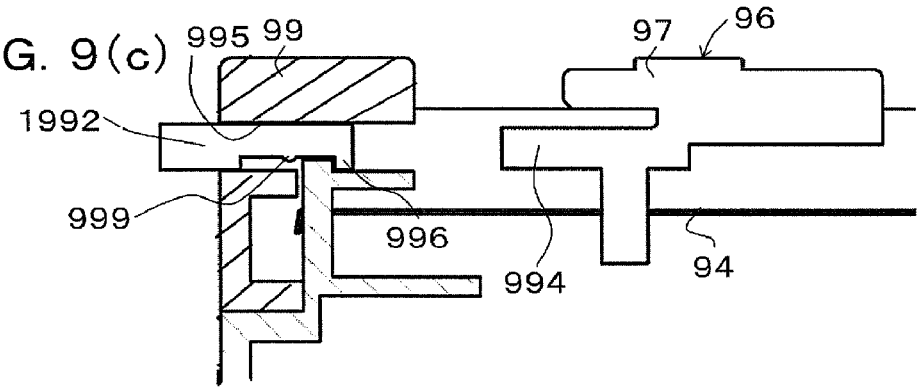

UP
LEFT
RIGHT
DOWN 390
399h
112
111
110
96
97
113
399
114
994
94

111
96
97
399
994
94

111
112
96
97
399h
399
994
94

PROCESS CARTRIDGE INCLUDING CLEANING MEMBER FOR CLEANING CHARGING WIRE

CROSS REFERENCE TO RELATED APPLICATION

This application claims priority from Japanese Patent Application No. 2008-287434 filed Nov. 10, 2008. The entire content of this priority application is incorporated herein by reference.

TECHNICAL FIELD

The present invention relates to a process cartridge and an image forming device including the process cartridge.

BACKGROUND

There has been proposed an image forming device such as a laser printer using an electrophotographic technique. Such a laser printer may include a process cartridge detachably mounted on a main casing, and the process cartridge includes a photosensitive drum, a charging unit, and a cleaning member. The charging unit includes a charging wire for charging a surface of the photosensitive drum. A user operates the cleaning member to clean the charging wire.

SUMMARY

It is an object of the invention to provide a process cartridge, wherein a user can easily recognize that a charging wire has been cleaned.

In order to attain the above and other objects, the invention provides an image forming device including a main casing, a process cartridge detachably attachable to the main casing, and a detecting mechanism disposed in the main casing. The process cartridge includes a frame, a photosensitive member disposed inside the frame and having a surface, a charging wire extending in the frame for charging the surface of the photosensitive member, a cleaning member that cleans the charging wire and that is movable in a moving region between a first position and a second position while sliding on the charging wire, and a moving member that is movable between a third position and a fourth position. A movement of the cleaning member from the first position to the second position moves the moving member in the third position to the fourth position, and the moving member remains in the fourth position when the cleaning member moves from the second position to the first position. The detecting mechanism detects the moving member in the fourth position in the course of attachment of the process cartridge to the main casing.

According to another aspect, the present invention provides a process cartridge including a frame, a photosensitive member disposed inside the frame and having a surface, a charging wire extending in the frame for charging the surface of the photosensitive member, a cleaning member that cleans the charging wire and that is movable in a moving region between a first position and a second position while sliding on the charging wire, and a moving member that is movable between a third position and a fourth position. A movement of the cleaning member from the first position to the second position moves the moving member in the third position to the fourth position, and the moving member remains in the fourth position when the cleaning member moves from the second position to the first position.

BRIEF DESCRIPTION OF THE DRAWINGS

The particular features and advantages of the invention as well as other objects will become apparent from the following description taken in connection with the accompanying drawings, in which:

FIG. 4(*b*) is a cross-sectional view taken along the line IV-IV of FIG. 3, wherein the wire cleaner is in abutment with the moving member in the first position;

FIG. 4(*c*) is a cross-sectional view taken along the line IV-IV of FIG. 3, wherein the wire cleaner is in a leftmost position and the moving member is in a second position;

FIG. 4(*d*) is a cross-sectional view taken along the line IV-IV of FIG. 3, wherein the wire cleaner is returning to the waiting position and the moving member is in the second position;

FIG. 4(*e*) is a cross-sectional view taken along the line IV-IV of FIG. 3, wherein the wire cleaner is in the waiting position and the moving member is in the second position;

FIG. 6(*b*) is a cross-sectional view taken along the line VI-VI of FIG. 2, illustrating the moving member moving the actuator in the course of inserting the process cartridge into the main casing of the laser printer;

FIG. 6(*c*) is a cross-sectional view taken along the line VI-VI of FIG. 2, illustrating the positions of the moving member and the actuator after the process cartridge is completely inserted into the main casing;

FIG. 7(*b*) is a cross-sectional view taken along the line VI-VI of FIG. 2, illustrating the actuator pushing the moving member into the frame of the process cartridge in the course of detaching the process cartridge from the main casing;

FIG. 7(*c*) is a cross-sectional view taken along the line VI-VI of FIG. 2, illustrating the process cartridge with the moving member completely pushed inside the frame;

FIG. 9(*a*) is a cross-sectional partial view showing essential part of a process cartridge according to a third embodiment of the present invention, illustrating a cleaning process for cleaning a charging wire with a wire cleaner, wherein the wire cleaner comes into abutment with a moving member in a first position;

FIG. 9(*b*) is a cross-sectional partial view showing the essential part of the process cartridge, wherein the wire cleaner is in a leftmost position and the moving member in a second position;

FIG. 9(*c*) is a cross-sectional partial view showing the essential part of the process cartridge, wherein the wire cleaner is returning to the waiting position and the moving member remains in the second position;

FIG. 10(*b*) is a cross-sectional partial view showing the essential part of the process cartridge, wherein the wire cleaner is pushing the moving member toward a second position;

FIG. 10(*c*) is a cross-sectional partial view showing the essential part of the process cartridge, wherein the wire cleaner is in a leftmost position and the moving member is in the second position.

DETAILED DESCRIPTION

An image forming device according to an embodiment of the present invention will be described with reference the accompanying drawings. The embodiment pertains to a laser printer 1. The terms "upward", "downward", "upper", "lower", "above", "below", "right", "left", "front", "rear" and the like will be used throughout the description assuming that the laser printer 1 is disposed in an orientation in which it is intended to be used.

Figure 1:
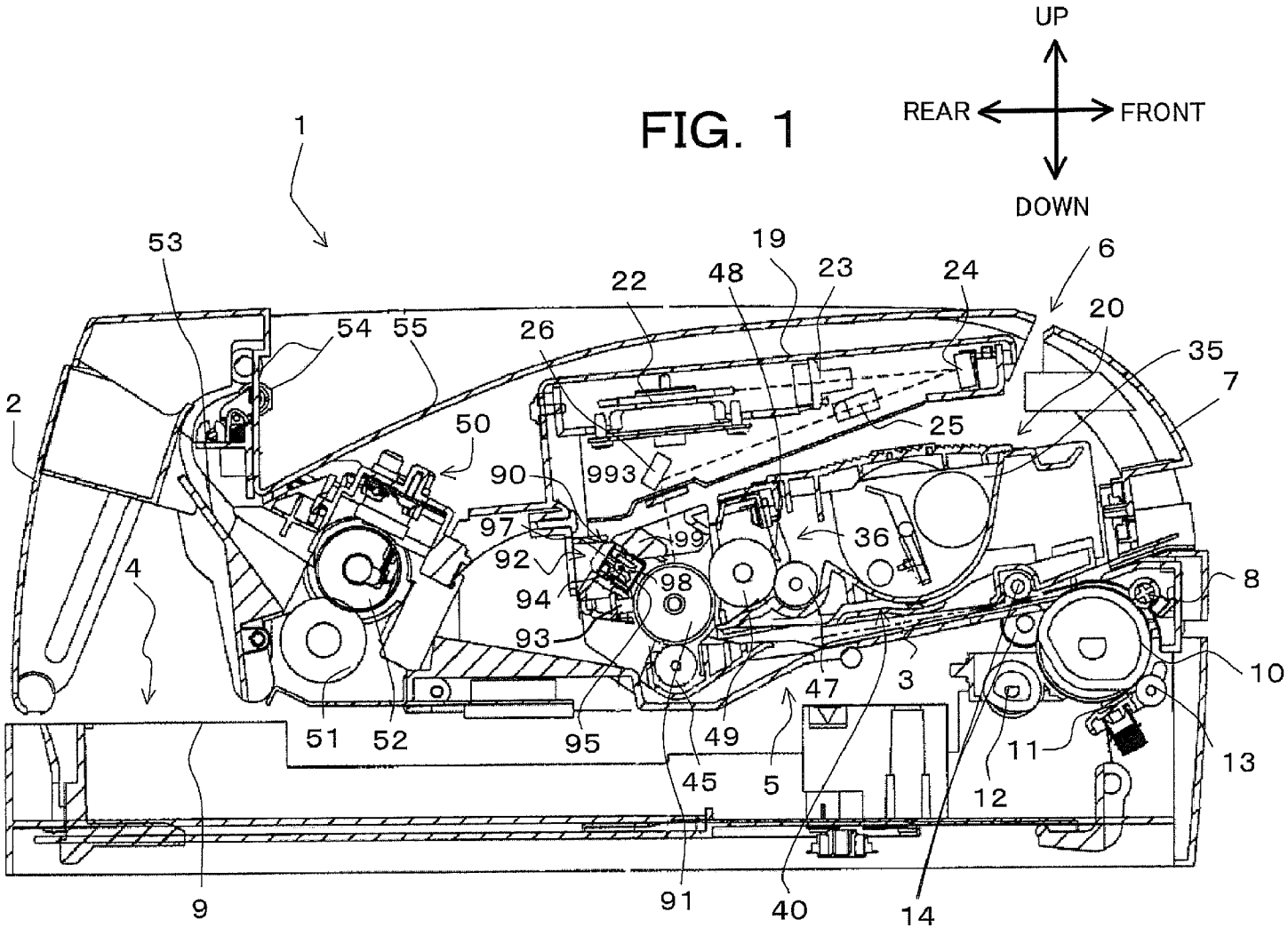
FIG. 1 is a cross-sectional side view of a laser printer according to an embodiment of the present invention.

As shown in FIG. 1, the laser printer 1 has a main casing 2 in which a sheet supply section 4 for supplying a sheet 3 and an image forming section 5 for forming an image on the sheet 3 are disposed.

Figure 2:
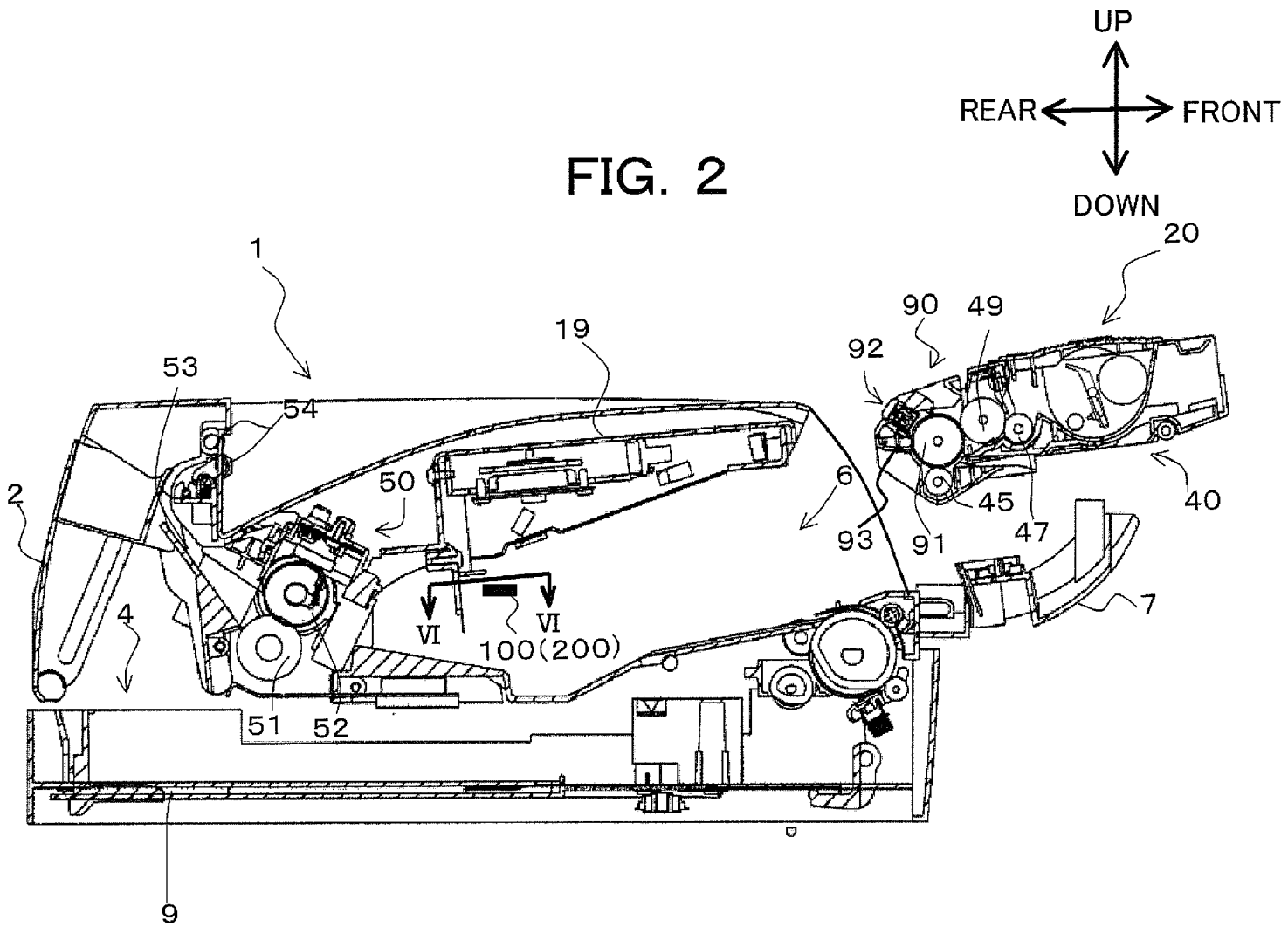
FIG. 2 is a cross-sectional side view of the laser printer with a process cartridge detached from the laser printer and with a front cover open.

The main casing 2 has a front opening 6 for attachment and detachment of a process cartridge 20. A front cover 7 is provided for selectively opening and closing the front opening 6, and is supported to a cover shaft (not shown). When the front cover 7 opens as shown in FIG. 2, the front opening 6 is exposed. In this condition, the process cartridge 20 can be attached to or detached from the main casing 2.

The sheet supply section 4 is provided in a lower section of the main casing 2, and includes a sheet supply tray 9 and a sheet supply mechanism. The sheet supply tray 9 is detachably installed in the main casing 2 for accommodating therein a stack of cut sheets 3. The sheet supply mechanism includes a sheet supply roller 10, a separation pad 11, a pickup roller 12, a pinch roller 13, a paper-dust removing roller 8, and a pair of registration rollers 14. The sheet supply roller 10 and the separation pad 11 are positioned above a front end portion of the sheet supply tray 9. The pickup roller 12 is positioned immediately rearward of the sheet supply roller 10. The pinch roller 13 is positioned immediately frontward of and lower than the sheet supply roller 10. The paper-dust removing roller 8 is positioned immediately frontward of and higher than the sheet supply roller 10. The pair of registration rollers 14 are vertically arrayed at a position above and rearward of the sheet supply roller 10.

Rotation of the pickup roller 12 feeds an uppermost sheet 3 in the sheet supply tray 9, and the sheet supply roller 10 and the separation pad 11 nip the sheet 3 therebetween for separating the uppermost sheet 3 from the remaining sheet stack. Then, the sheet 3 is supplied to the image forming section 5 by the pinch roller 13 and the pair of registration rollers 14.

The image forming section 5 includes a scanner unit 19, the process cartridge 20, and a fixing unit 50. The scanner unit 19 is disposed in the upper section of the process cartridge 20 and includes a polygon mirror 22, an fθ lens 23, reflection mirrors 24 and 26, and a lens 25. As shown by a broken line, a laser beam emitted from a laser light source (not shown) based on image data is deflected at the polygon mirror 22, passes through the fθ lens 23, is reflected at the reflection mirror 24, passes through the lens 25, is bent downward by the reflection mirror 26, and is irradiated onto a surface of a photosensitive drum 91 assembled to the process cartridge 20.

The process cartridge 20 is positioned below the scanner unit 19 and is detachably attached to the main casing 2 (FIG. 2). The process cartridge 20 includes a drum cartridge 90 and a developing cartridge 40 detachably attached to the drum cartridge 90.

The developing cartridge 40 is partitioned into a toner chamber 35 and a developing chamber 36. The toner chamber 35 accommodates toner as developing agent. Disposed inside the developing chamber 36 are a toner supply roller 47, a developing roller 49, and a blade 48. The toner accommodated in the toner chamber 35 is supplied to the developing roller 49 by a rotation of the toner supply roller 47. At this time, the toner is triboelectrically charged with positive polarity between the toner supply roller 47 and the developing roller 49 to which a developing bias is applied.

The toner supplied onto the developing roller 49 is subjected to thickness regulation by the blade 48. Thus, a toner layer of uniform thickness is carried on the developing roller 49.

The drum cartridge 90 includes a frame 99, the photosensitive drum 91, a Scorotron charger 92, a transfer roller 45, and a cleaning brush 93.

The surface of the photosensitive drum 91 is uniformly charged with positive polarity by the Scorotron charger 92 while the photosensitive drum 91 rotates. Then, the surface is exposed to a high-speed scanning of laser beam from the scanner unit 19 to form an electrostatic latent image on the surface.

When the positively charged toner carried on the surface of the developing roller 49 opposes and contacts the photosensitive drum 91 as the developing roller 49 rotates, the toner is selectively supplied to the electrostatic latent image on the surface of the photosensitive drum 91, i.e., to areas of the surface of the uniformly charged photosensitive drum 91 that were exposed to the laser beam and, therefore, have a lower potential than the rest of the surface. As a result, the electrostatic latent image on the photosensitive drum 91 is transformed into a visible toner image. In this way, a reverse development is performed.

Then, the toner image carried on the surface of the photosensitive drum 91 is transferred onto the sheet 3 by a transfer bias applied to the transfer roller 45 when the sheet 3 conveyed by the registration rollers 14 passes a transfer position between the photosensitive drum 91 and the transfer roller 45. Then, the sheet 3 with the toner image transferred thereon is conveyed to the fixing unit 50. Paper dust transferred from the sheet 3 to the photosensitive drum 91 can be removed by the cleaning brush 93.

The fixing unit 50 includes a heat roller 52 and a pressure roller 51 for thermally fixing the toner image onto the sheet 3 while the sheet 3 passes between the heat roller 52 and the pressure roller 51. The sheet 3 with the toner image fixed thereon is conveyed along a discharge path 53 that diagonally upwardly extends from the fixing unit 50 to an upper surface of the main casing 2, and is discharged by discharge rollers 54 onto a discharge tray 55 formed at the upper surface of the main casing 2.

The drum cartridge 90 will be described further. As shown in FIG. 5, the frame 99 of the drum cartridge 90 is Beamed in a box shape having a bottom wall (not shown) and a pair of right and left side walls 99R and 99L (FIG. 4(*a*)) extending upward from the right and left sides of the bottom wall. The photosensitive drum 91 is disposed inside the frame 99 and has a rotation shaft extending in a widthwise (right-to-left) direction that is supported to the right and left side walls 99R and 99L of the frame 99.

Figure 3:
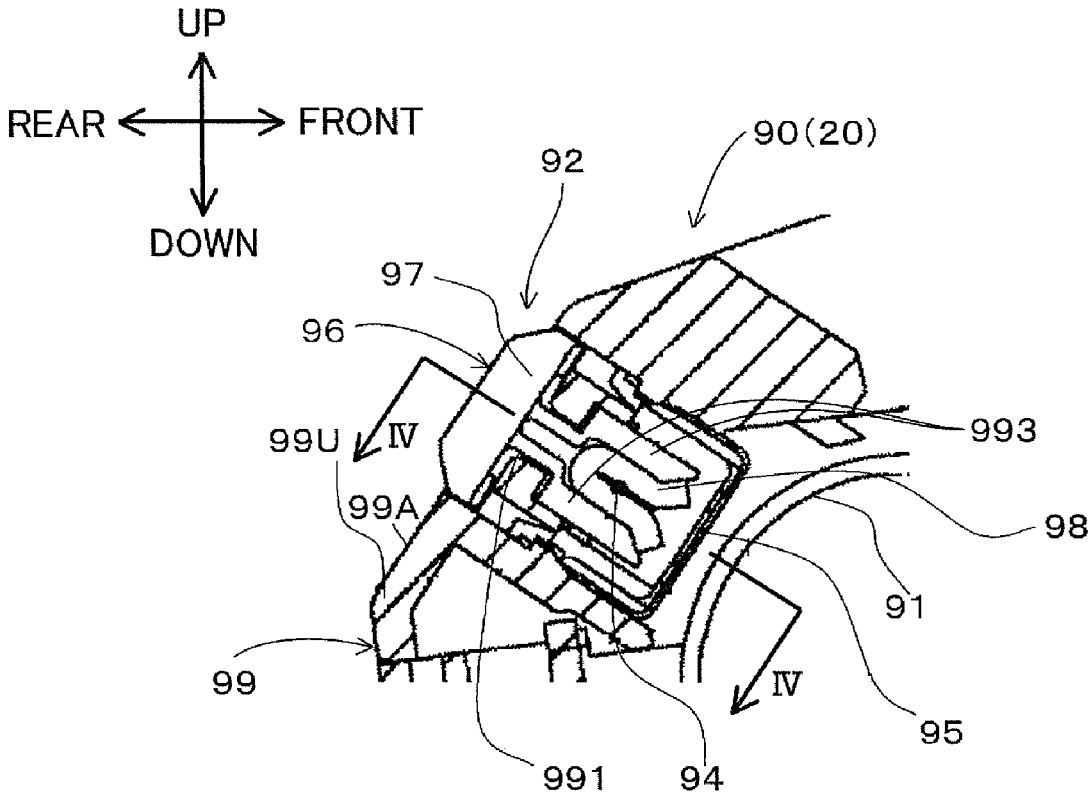
FIG. 3 is a cross-sectional partial view showing essential part of the process cartridge.

As shown in FIG. 3, the frame 99 also has an upper rear wall 99U located above and diagonally rearward of the photosensitive drum 91. The upper rear wall 99U has a slanting surface 99A and is formed with a through hole 991 that is elongated in the widthwise direction as shown in FIG. 5.

As shown in FIG. 3, the Scorotron charger 92 is disposed above and diagonally rearward of the photosensitive drum 91 with a space therebetween so as to avoid direct contact with the photosensitive drum 91. The Scorotron charger 92 includes a charging wire 94 and a grid 95 both disposed within the frame 99.

The charging wire 94 extends in the widthwise direction parallel to the photosensitive drum 91 between the right and left side walls 99R and 99L of the frame 99 and is supported thereto. The photosensitive drum 91 has an image forming area in the middle in the widthwise direction and non-image forming areas one on either side of the image forming area. The charging wire 94 extends across the entire width of the photosensitive drum 91 including the image forming area and the non-image forming areas, and includes a middle area in the middle and side areas one on either side of the middle area. The middle area correspond to the image forming area of the photosensitive drum 91, and the side areas corresponds to the non-image forming areas of the photosensitive drum 91. Although not shown in the drawings, an electric circuit board is provided to the process cartridge 20 for applying high voltage to the charging wire 94 through a wire electrode.

The grid 95 extends between and is supported to the right and left side walls 99R and 99L of the frame 99. The grid 95 is located below and diagonally frontward of the charging wire 94 so as to cover nearly the entire width of the charging wire 94. The grid 95 is applied with bias voltage from the electric circuit board (not shown) through a grid electrode (not shown).

The charging wire 94 generates a corona discharge to uniformly charge the surface of the photosensitive drum 91 with a positive polarity when the bias voltage and the high voltage are respectively applied to the grid 95 and the charging wire 94 at the same time.

As shown in FIG. 3, the drum cartridge 90 further includes a wire cleaner 96 for cleaning the charging wire 94. The wire cleaner 96 includes an operating portion 97 and a cleaning member 98.

The operating portion 97 has a substantial rectangular shape in a plan view. The operating portion 97 is disposed to penetrate through the through hole 991 and protrudes outside the frame 99. The operating portion 97 is supported to the upper rear wall 99U so as to be slidable in the widthwise direction along the groove 991. The operating portion 97 is formed with a pair of protrusions 993 on the lower side.

The cleaning member 98 is made of elastic material such as sponge and is disposed on inner surfaces of the protrusions 993. The cleaning member 98 nips a part of the charging wire 94 and is in contact with a part of an outer periphery of the cleaning member 98. With this configuration, when the wire cleaner 96 moves in the widthwise direction along the groove 991, the cleaning member 98 slides on the charging wire 94, thereby cleaning the charging wire 94. Note that the wire cleaner 96 is movable in a moving region between a waiting position shown in FIG. 4(*a*) and a leftmost position shown in FIG. 4(*c*). Both the waiting position and the leftmost position are in the side areas described above.

Figures 4A, 4B, 4C, 4D, 4E:
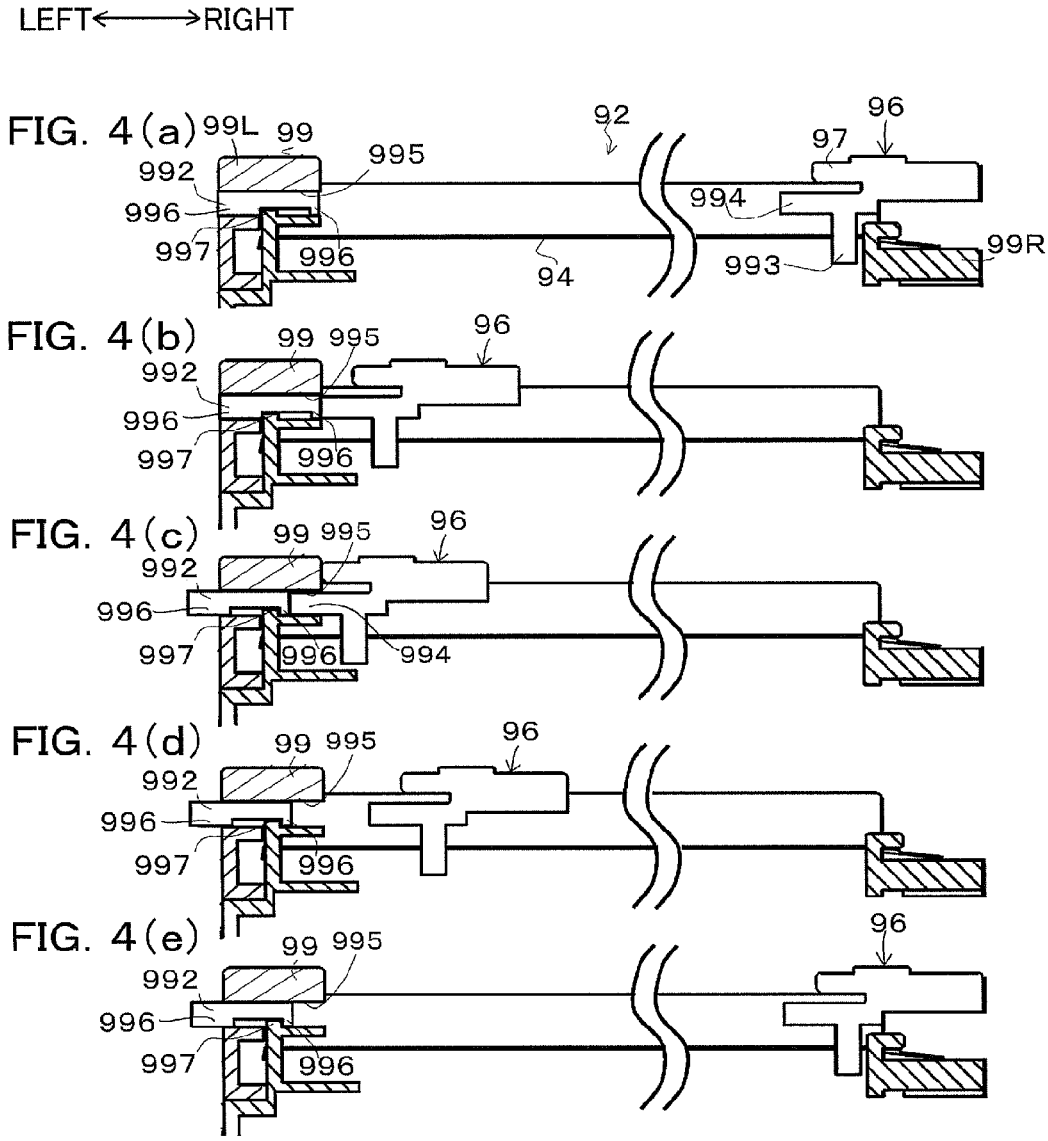
FIG. 4(*a*) is a cross-sectional view taken along a line IV-IV of FIG. 3, illustrating a cleaning process for cleaning a charging wire with a wire cleaner, wherein the wire cleaner is in a waiting position and a moving member is in a first position.
Figure 5:
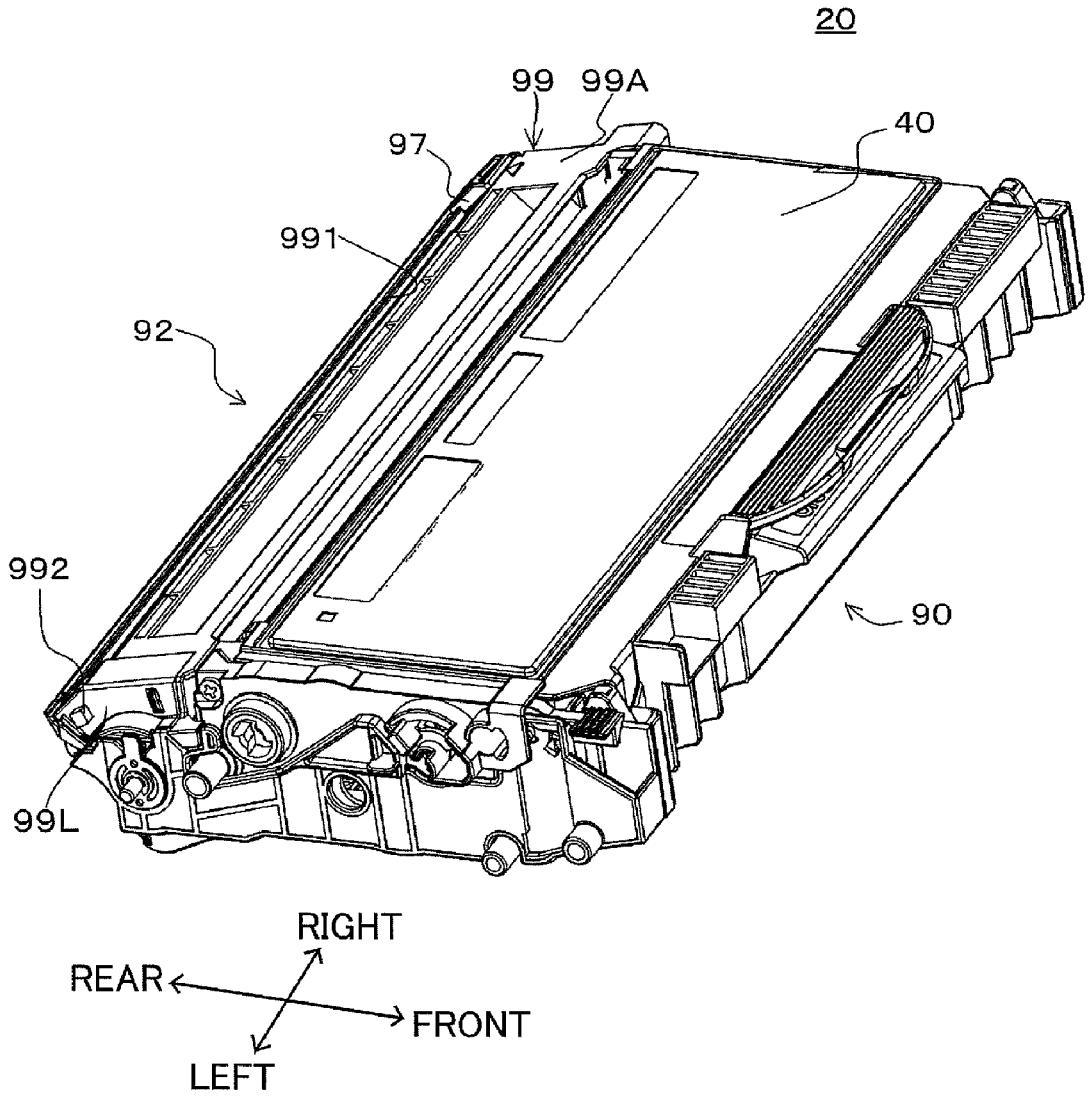
FIG. 5 is a perspective view of the process cartridge.

As shown in FIG. 4(*a*), the operating portion 97 is also formed with a pushing member 994 on the lower side. The pushing member 994 protrudes leftward from the protrusions 993.

As shown in FIG. 4(*a*), the left side wall 99L of the frame 99 is formed with a through hole 995 at a position near the groove 991 (FIG. 5). The through hole 995 penetrates through the left side wall 99L in a direction substantial parallel to the widthwise direction. A moving member 992 is disposed in the through hole 995 so as to be movable in the widthwise direction. The moving member 992 is a rod-like member extending in the widthwise direction. The moving direction of the moving member 992 is substantial parallel to the moving direction of the wire cleaner 96 and is substantial orthogonal to an attachment/detachment direction of the process cartridge 20 to/from the process cartridge 20.

The moving member 992 has a pair of protrusions 996 with a space therebetween in the widthwise direction. A latch 997 is formed on an inner surface of the through hole 995. Either of the protrusions 996 abuts the latch 997, thereby regulating a moving region of the moving member 992. Thus, the moving member 992 is movable between a first position shown in FIG. 4(*a*) and a second position shown in FIG. 4(*c*). The latch 997 also prevents the moving member 992 from coming off the through hole 995.

When the moving member 992 is at the first position as shown in FIG. 4(*a*), a right end of the moving member 992 is in the moving region of the wire cleaner 96. Thus, when the wire cleaner 96 moves to the leftmost position, the pushing member 994 of the operating portion 97 of the wire cleaner 96 abuts and moves the moving member 992 to the second position as shown in FIG. 4(*c*). When the moving member 992 is at the second position, a left end of the moving member 992 protrudes outside the frame 99 as shown in FIGS. 4(*c*) and 5. Note that the left end of the moving member 992 in the first position does not protrude outside the frame 99.

An appropriate amount of frictional force is generated between the moving member 992 and the inner surface of the through hole 995 so that the frictional force prevents the moving member 992 from being moved within the through hole 995 by its own weight when the process cartridge 20 is tilted, for example.

Figure 6A:
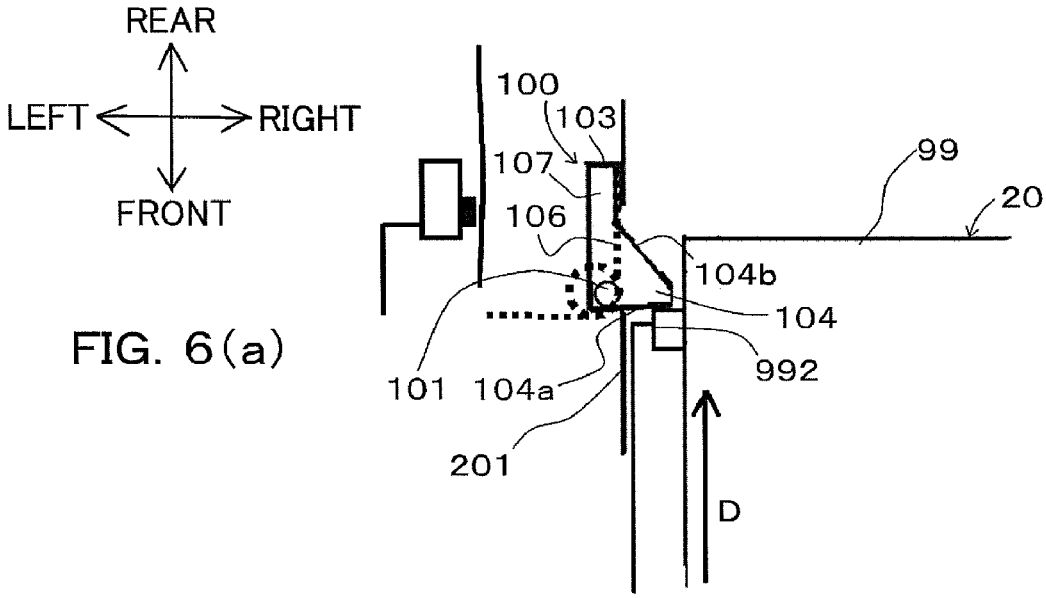
FIG. 6(*a*) is a cross-sectional view taken along a line VI-VI of FIG. 2, wherein the moving member comes into abutment with an actuator in the course of inserting the process cartridge into a main casing of the laser printer.
Figure 6B:
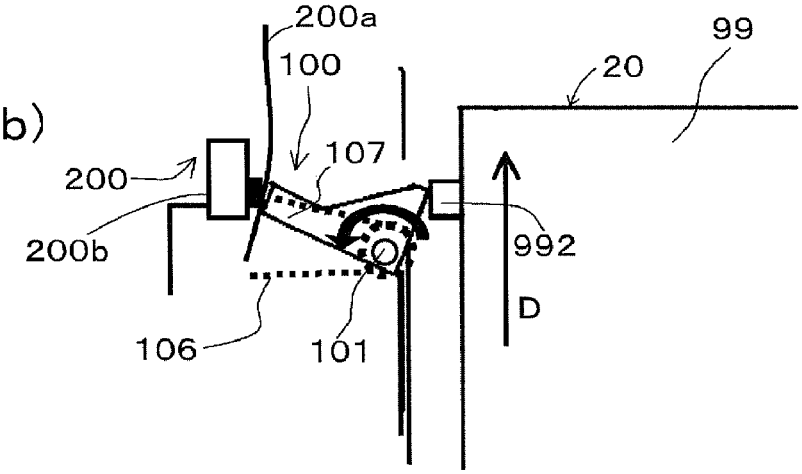
Figure 6C:
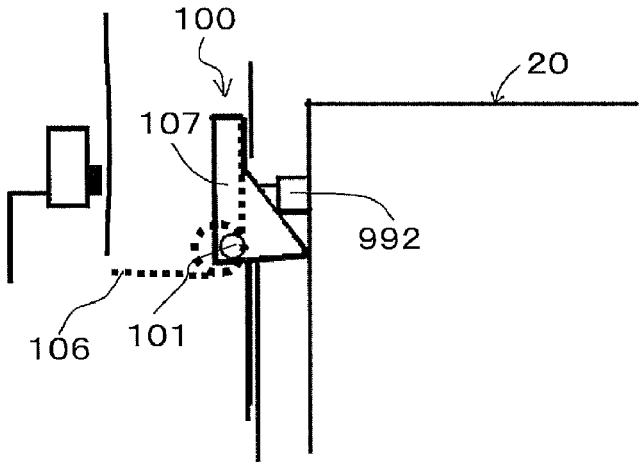

As shown in FIG. 2, the laser printer 1 further includes a detecting mechanism including an actuator 100 and a detecting unit 200 disposed inside the main casing 2. The actuator 100 is moved by the moving member 992 in the second position in the course of attachment of the process cartridge 20 to the main casing 2. The detecting unit 200 is a contact-type sensor for detecting the movement of the actuator 100. As shown in FIG. 6(*a*), the detecting unit 200 includes a contact 200*a* and a terminal 200*b*. The detecting unit 200 outputs a detection signal to an electric circuit (not shown) in the main casing 2 when the detecting unit 200 detects the movement of the actuator 100. Details will be described later.

Next, a cleaning operation for cleaning the charging wire 94 will be described. Non-conductive foreign matters, such as silica or toner, cling to the charging wire 94 with long-term use of the charging wire 94. The foreign matters clinging to the charging wire 94 degrades the discharge ability of the charging wire 94, resulting in failure to charge the surface of the photosensitive drum 91 uniformly. In order to remove the foreign matters from the charging wire 94, the cleaning operation needs to be performed regularly.

In order to perform the cleaning operation, first a user detaches the process cartridge 20 from the main casing 2 as shown in FIG. 2. At this time, as shown in FIG. 4(*a*), the wire cleaner 96 is in the waiting position, and the moving member 992 is in the first position. In the waiting position, the cleaning member 98 of the wire cleaner 96 is in contact with a right part of the charging wire 94, which is in the side area corresponding to the non-image forming region of the photosensitive drum 91. Therefore, staying in the waiting position, the wire cleaner 96 does not interfere with a charging operation of the charging wire 94.

Next, the user moves the wire cleaner 96 leftward as shown in FIG. 4(*b*) by holding the operating portion 97. As a result, the cleaning member 98 slides on the charging wire 94, thereby removing dust and the like clinging to the charging wire 94.

When the user moves the wire cleaner 96 further to the leftmost position as shown in FIG. 4(*c*), then the pushing member 994 of the wire cleaner 96 abuts and pushes the moving member 992 to the second position where the left end portion of the moving member 992 protrudes outside the frame 99.

Then, the user returns the wire cleaner 96 to the waiting position. That is, the user moves the wire cleaner 96 rightward as shown in FIG. 4(*d*). At this time also, the cleaning member 98 slides on the charging wire 94 to clean the same. However, the moving member 992 remains in the second position with the left end portion protruding outside. Returning the wire cleaner 96 to the waiting position as shown in FIG. 4(*e*), the cleaning process completes. Then, the user returns the process cartridge 20 into the main casing 2.

Because the left end portion of the moving member 992 remains protruding outside the frame 99 after the cleaning operation is performed as described above, anyone can see easily that the charging wire 94 was cleaned.

Next, a detecting operation will be described. The detecting operation is performed for detecting whether or not the cleaning operation has been performed in the process cartridge 20 detached from the main casing 2, as the process cartridge 20 is mounted on the main casing 2.

A left side plate 201 shown in FIG. 6(*a*) is disposed within the main casing 2 so as to extend in a direction substantial orthogonal to the widthwise direction and is formed with a through hole 201*a*.

The actuator 100 is supported to the left side plate 201. More specifically, the actuator 100 includes a support shaft 101, a pivot member 107, and a spring 106. The support shaft 101 extends in the vertical direction and is supported to the left side plate 201. The pivot member 107 is pivotally supported to the support shaft 101. The spring 106 urges the pivot member 107 in a clockwise direction in a plan view. The pivot member 107 includes a rod part 103 and a protruding part 104. The rod part 103 extends in a radial direction from the support shaft 101. The protruding part 104 protrudes rightward beyond the left side plate 201 through the through hole 201*a*. The protruding part 104 has a front surface 104*a* and a rear slant surface 104*b* that extends between the front surface 104*a* and the rod part 103.

When the pivot member 107 is in a normal state as shown in FIG. 6(*a*), the spring 106 urges the rod part 103 against the left side plate 201, and the front surface 104*a* of the protruding part 104 is substantial orthogonal to an insert direction D in which the process cartridge 20 is inserted into the main casing 2 when mounted thereto, and the rear slant surface 104*b* extends in a direction from the front right to the rear left. Note that the attachment/detachment direction of the process cartridge 20 (the insert direction D shown in FIG. 6(*a*) and a detachment direction E shown in FIG. 7(*a*)) is substantial orthogonal to the widthwise direction.

With this configuration, when the process cartridge 20 is inserted into the main casing 2 in the insert direction D, the moving member 992 in the second position abuts the front surface 104*a* of the protruding part 104 of the actuator 100 and pivots the pivot member 107 in a counterclockwise direction against the urging force of the spring 106 as shown in FIG. 6(*b*). As a result, the contact 200*a* contacts the terminal 200*b*, thereby turning ON electricity, and a detection signal is transmitted to the electric circuit in the main casing 2.

Upon detecting the detection signal, a controller (not shown) of the laser printer 1 performs a suitable operation, such as an operation to erase a message on a display unit (not shown) urging a user to clean the charging wire 94.

The frictional force between the moving member 992 and the inner surface of the through hole 995 is greater than the urging force of the spring 106. Thus, the moving member 992 is prevented from returning to the first position by the urging force of the spring 106 when the moving member 992 comes into abutment with the front surface 104*a* of the protruding part 104.

When the insertion of the process cartridge 20 is completed as shown in FIG. 6(*c*), the moving member 992 is past the protruding part 104, and the pivot member 107 is returned to the normal position by the urging force of the spring 106.

Figure 7A:
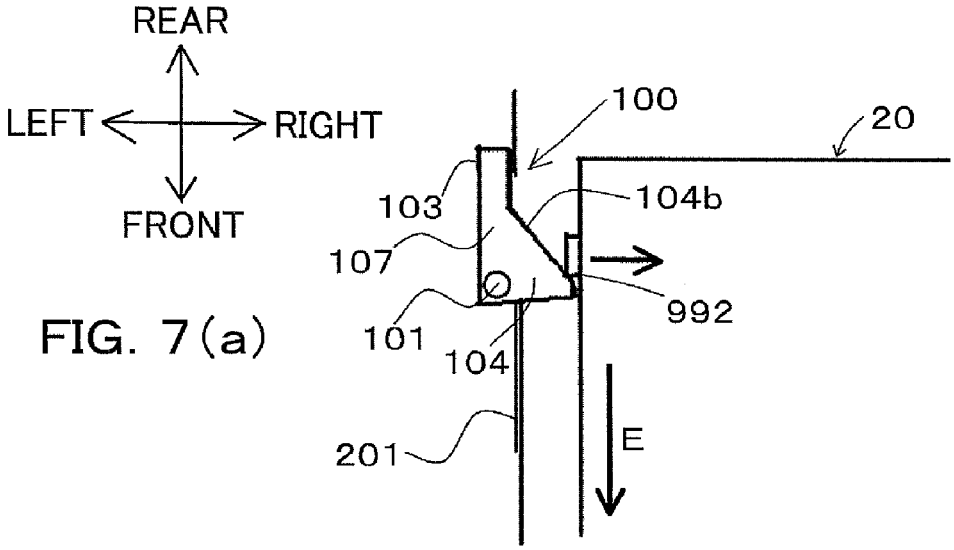
FIG. 7(*a*) is a cross-sectional view taken along the line VI-VI of FIG. 2, illustrating the actuator pushing the moving member into a frame of the process cartridge in the course of detaching the process cartridge from the main casing.
Figure 7B:
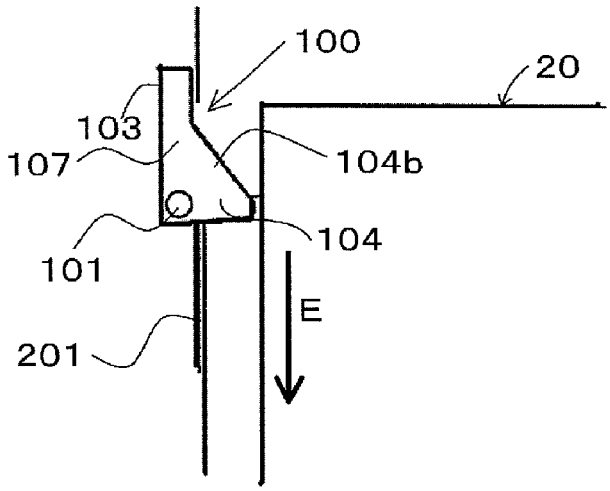
Figure 7C:
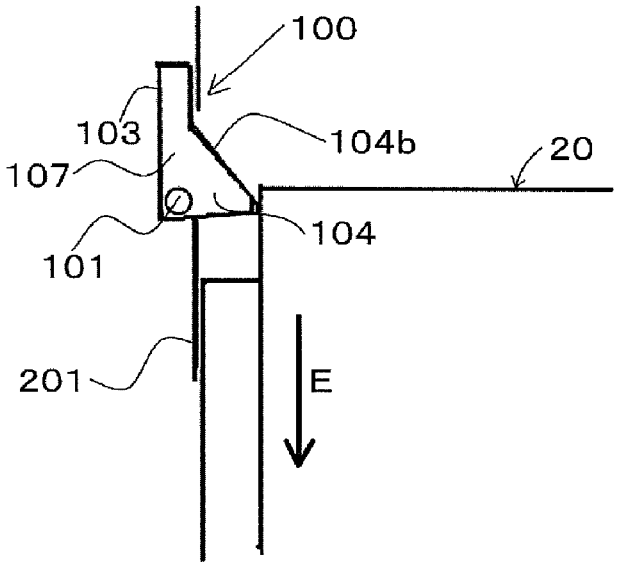

After image forming operation is performed for a certain amount of time, the charging wire 94 needs to be cleaned again. In this case, the user again detaches the process cartridge 20 from the main casing 2. More specifically, the moving member 992 is maintained in the second position as shown in FIG. 6(*c*) when the process cartridge 20 is in the main casing 2. However, as the process cartridge 20 is removed form the main casing 2 in the detachment direction E as shown in FIG. 7(*a*), the moving member 992 abuts the rear slant surface 104*b* of the protruding part 104.

As the process cartridge 20 moves further in the detachment direction E, the moving member 992 presses the protruding part 104 frontward. However, because the rod part 103 is in abutment with the left side plate 201, the pivot member 107 cannot pivot in the clockwise direction further. Therefore, the moving member 992 is moved rightward to the first position as shown in FIG. 7(*b*) by a reaction force from the protruding part 104. In this manner, the moving member 992 is returned to the first position within the frame 99. Thus, by the time the process cartridge 20 is completely detached from the main casing 2, the moving member 992 is returned to the first position without protruding outside the frame 99 as shown in FIG. 7(*c*).

As described above, according to the present embodiment, the moving member 992 is moved to the second position in the cleaning process performed while the process cartridge 20 is in detachment from the main casing 2, and the moving member 992 remains in the second position even after the wire cleaner 96 is returned to the waiting position. This enables to detect that the cleaning process has been performed when the process cartridge 20 is returned to the main casing 2 after the cleaning process.

Also, because the detecting unit 200 detects that the cleaning process has been performed by detecting the movement of the actuator 100 which is caused by the attachment of the process cartridge 20, a configuration for the detection can be simplified.

Further, because the moving direction of the moving member 992 is substantially orthogonal to the insert direction D, it is unlikely that the moving member 992 is accidentally returned to the first position by a shock or impact generated in the course of attachment of the process cartridge 20. This enables reliable detection.

Moreover, because the moving member 992 returns to the first position in the course of detachment of the process cartridge 20, the process cartridge 20 is attached to the main casing 2 with the moving member 992 in the first position if the cleaning process is not performed while the process cartridge 20 is detached. This prevents false detection.

Because the moving direction of the moving member 992 is the same as the moving direction of the wire cleaner 96, the wire cleaner 96 can smoothly move the moving member 992 from the first position to the second position.

Next, first to third modifications of the embodiment will be described. It is to be noted that like parts or like portions as those in the embodiment are designated by like reference numerals, and duplicate description is omitted with respect to the arrangement same as that described with reference to the above-described embodiment.

Figure 8:
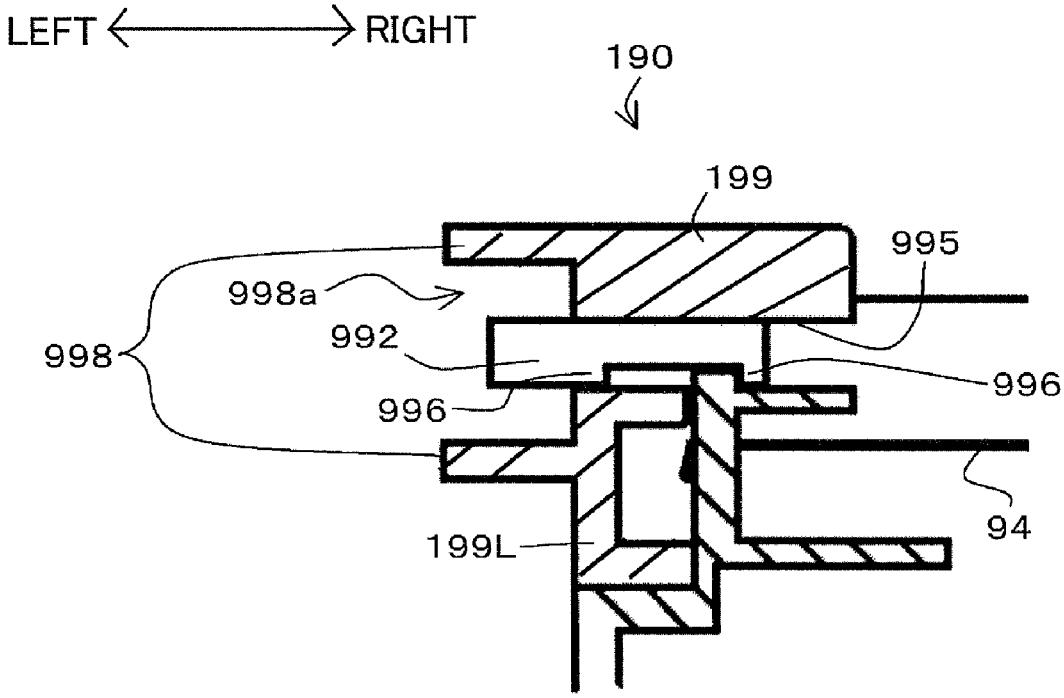
FIG. 8 is a cross-sectional partial view showing essential part of a process cartridge according to a first modification of the embodiment of the present invention.

First, the first modification of the embodiment will be described with reference to FIG. 8. As shown in FIG. 8, a drum cartridge 190 according to the first modification includes a frame 199 having a left side wall 199L. The left side wall 199L is formed with a pair of protection ribs 998 as a protecting member on an outer surface such that the left end portion of the moving member 992 in the second position locates between the protection ribs 998. The protection ribs 998 protrude leftward in the widthwise direction and are in opposition to each other in the insert direction D. The protection ribs 998 define a space 998*a* therebetween. The space 998*a* is formed large enough to accommodate the protruding part 104 of the actuator 100 (FIG. 6(*a*)) therein. The protection ribs 998 extend leftward further than the left end portion of the moving member 992 in the second position.

With this configuration, the protection ribs 998 can prevent a user from accidentally touching and pushing the moving member 992 in the second position to the first position.

Because the space 998*a* is defined between the protection ribs 998, the protection ribs 998 do not interfere with the detecting operation by the actuator 100 and the detecting unit 200. Thus, the actuator 100 and the detecting unit 200 can together perform reliably the detection operation.

Although the protection ribs 998 are used as the protecting member in this modification, the protecting member is not limited to the protection ribs 998. The protecting member can be any member as long as the member protrudes outward further than the left end portion of the moving member 992 in the second position does.

Next, the second modification of the embodiment will be described with reference to FIGS. 9(*a*) to 9(*c*). As shown in FIG. 9(*a*), a drum cartridge 290 according to the second modification includes a moving member 1992. The moving member 1992 is formed with a protrusion 999 as a regulating member on a surface facing the latch 997 in addition to the pair of protrusions 996.

The protrusion 999 of the moving member 1992 interferes with the latch 997 both when the moving member 1992 is in the first position shown in FIG. 9(*a*) and in the second position shown in FIG. 9(*c*).

With this configuration, the moving member 992 is prevented from moving from the first position to the second position or from the second position to the first position by the protrusion 999 abutting the latch 997 unless a force greater than a predetermined force is applied on the moving member 992 in the widthwise direction. When a force greater than the predetermined force is applied on the moving member 992 in the widthwise direction, however, then at least one of the protrusion 999 and the latch 997 deforms, letting the moving member 1992 move from the first position to the second position or from the second position to the first position.

When the user operates the operating portion 97 to move the wire cleaner 96 from the waiting position to the leftmost position, a force greater than the predetermined force is applied, so the moving member 992 moves from the first position to the second position as shown in FIG. 9(*b*). Also, when the process cartridge 20 is detached from the main casing 2, the actuator 100 pushes the moving member 1992 rightward in the manner described above. Because a force greater than the predetermined force is applied on the moving member 1992 at this time, the moving member 1992 is moved from the second position to the first position.

This configuration prevents the moving member 1992 from accidentally moving from one of the first and second positions to the other of the first and second positions even if some force is applied on the moving member 1992 as long as the force is smaller than the predetermined force.

It should be noted that the drum cartridge 290 may include the frame 199 of the first modification which is formed with the protection ribs 998 as shown in FIG. 8.

Next, the third modification of the embodiment will be described with reference to FIGS. 10(*a*) to 11. A drum cartridge 390 according to the third modification includes a frame 399 and a moving member 111. The moving member 111 is pivotably supported to a pivot shaft 110, which is supported to the frame 399 and extending in the front-to-rear direction. The moving member 111 is pivotable between a first position shown in FIG. 10(*a*) and a second position shown in FIG. 10(*c*). The moving member 111 is an L-shaped member including a first rod member 114 and a second rod member 113 both protrude in a radial direction from the pivot shaft 110. The second rod member 113 extends in a direction orthogonal to the first rod member 114. When the moving member 111 is in the first position shown in FIG. 10(*a*), the first rod member 114 extends downward, and the second rod member 113 extends leftward.

Figures 10A, 10B, 10C:
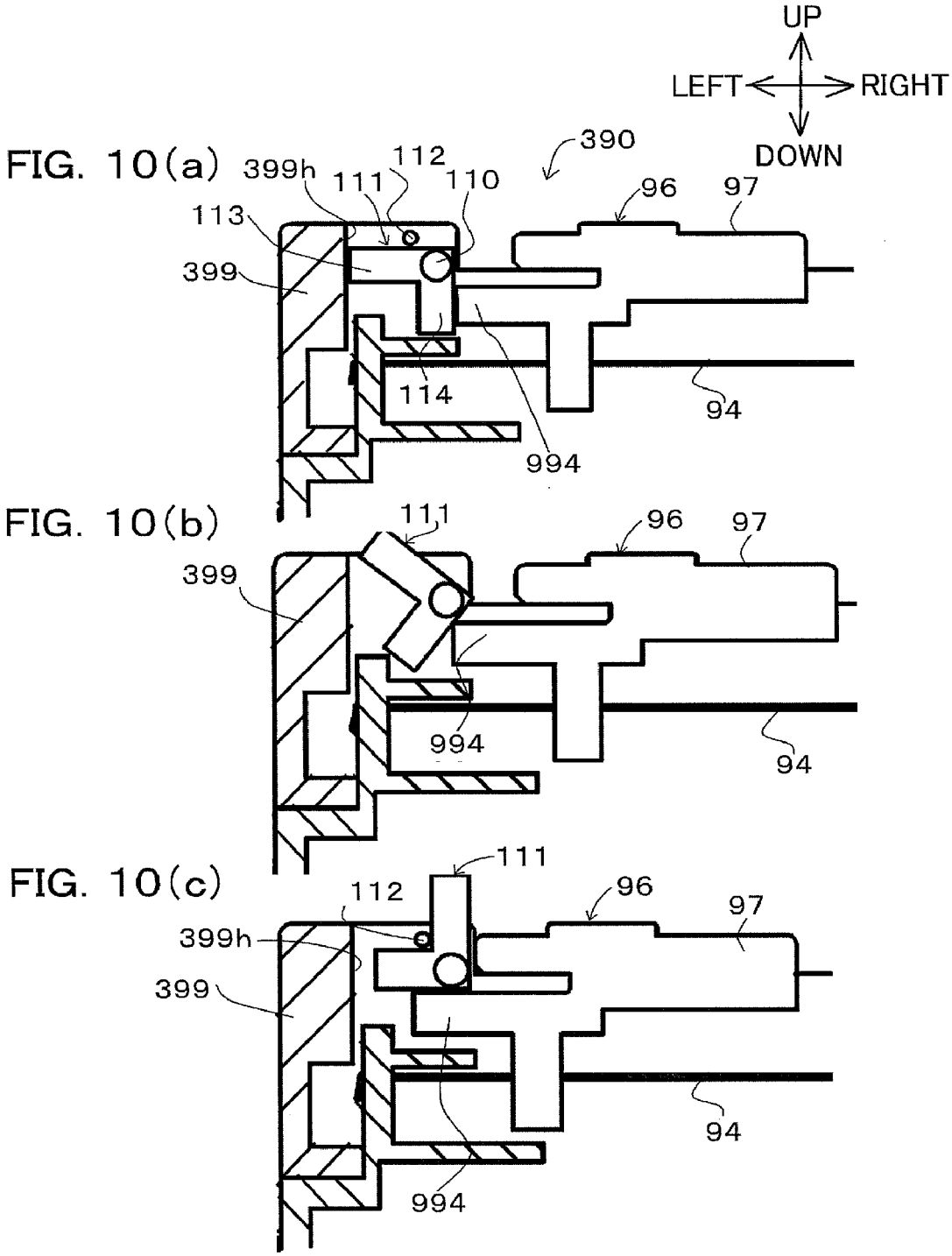
FIG. 10(*a*) is a cross-sectional partial view showing essential part of a process cartridge according to a third modification of the embodiment of the present invention, illustrating a cleaning process for cleaning a charging wire with a wire cleaner, wherein the wire cleaner comes into abutment with a moving member in a first position.

With this configuration, when the wire cleaner 96 moves leftward, the pushing member 994 abuts the first rod member 114 of the moving member 111, so the moving member 111 pivots in a clockwise direction about the pivot shaft 110 as shown in FIG. 10(*b*).

When the wire cleaner 96 is moved further to the leftmost position as shown in FIG. 10(*c*), the moving member 111 pivots further to the second position where the second rod member 113 protrudes upward to a position outside the frame 399 through a through hole 399*h*.

Figure 11:
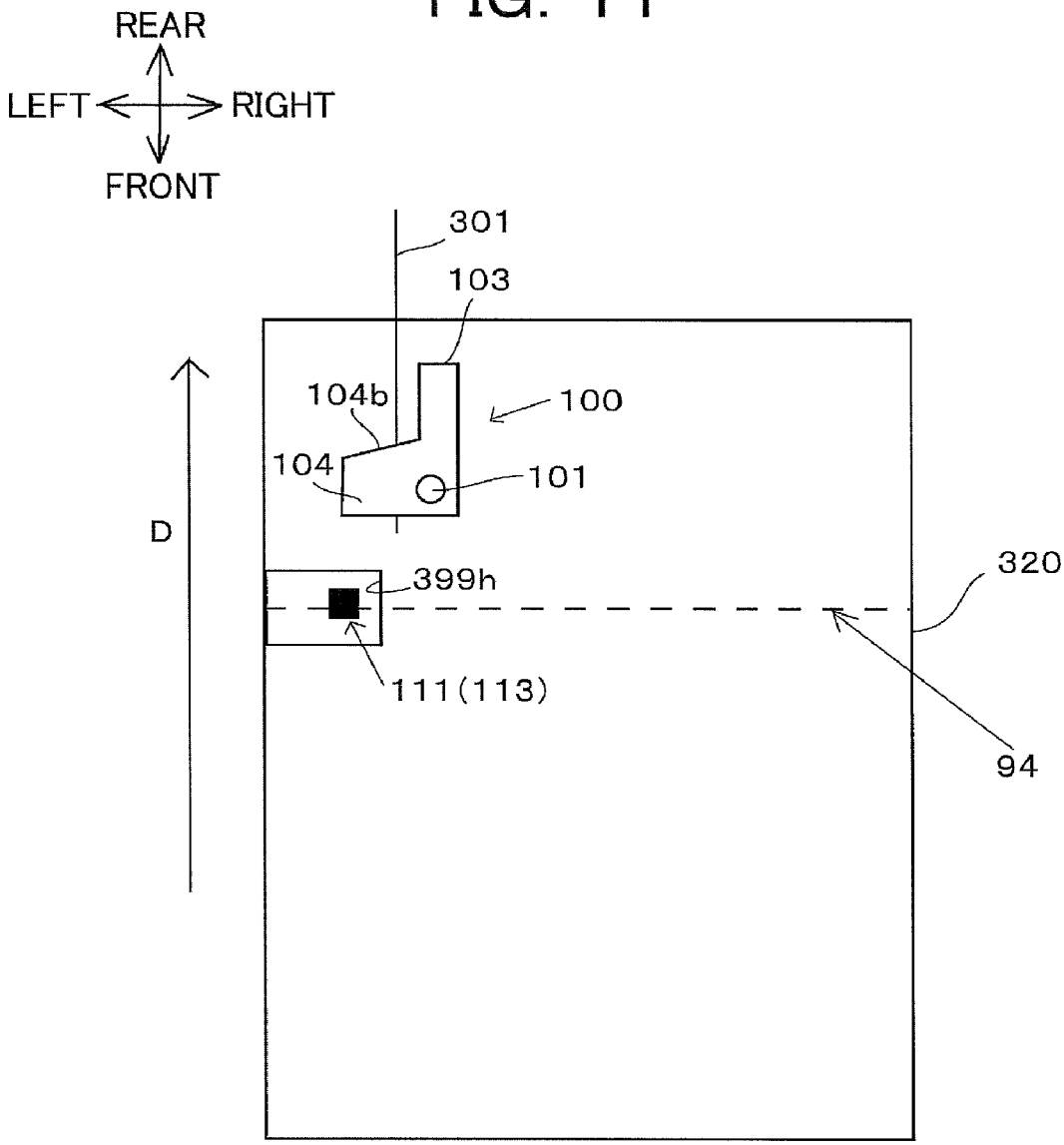
FIG. 11 is a cross-sectional partial view illustrating the process cartridge being inserted into the main casing.

As shown in FIG. 11, an upper side plate 301 instead of the left side plate 201 is disposed within the main casing 2. The upper side plate 301 extends in a direction substantial parallel to the insert direction D and is formed with a through hole 301*a*. The actuator 100 is supported to the upper side plate 301, and the detecting unit 200 is disposed near the actuator 100. With this configuration also, the second rod member 113 protruding outside the frame 399 abuts and moves the actuator 100 in the course of attachment of the process cartridge 20 to the main casing 2 as in the above-described embodiment. Also, the moving member 111 is returned to the first position in the course of detachment of the process cartridge 20 from the main casing 2 by the protruding part 104 of the actuator 100 abutting and pushing the second rod member 113 as in the above-described embodiment.

As shown in FIG. 10(*a*), it is preferable that a protrusion 112 be formed in the frame 399 at a position on a moving path of the moving member 111 such that at least one of the protrusion 112 and the second rod member 113 deforms to enable the moving member 111 to move from one of the first and second positions to the other of the first and second positions when a force greater than the predetermined force is applied. That is, the protrusion 112 and the second rod member 113 function in the same manner as the protrusion 999 and the latch 997 of the second modification described above (FIG. 9(*a*)). However, the protrusion 112 may be dispensed with, and the moving member 111 may be held either the first position or the second position by a frictional force between the frame 399 and the moving member 111.

While the invention has been described in detail with reference to the embodiment thereof, it would be apparent to those skilled in the art that various changes and modifications may be made therein without departing from the spirit of the invention.

For example, any sensor other than the contact-type sensor can be used as the detecting unit 200. For example, the detecting unit 200 may include a light emitting unit and a light receiving unit one disposed on either side of the moving path of the rod part 103 of the actuator 100 such that the detecting unit 200 detects the movement of the rod part 103 of the actuator 100 based on a light received at the light receiving unit.

Also, in the above embodiment and modifications, the moving member 992, 111 stays inside the frame 99, 199, 399 in the first position and protrudes outside the frame 99, 199, 399 in the second position. However, the moving member 992, 111 may stay inside or protruding outside the frame 99, 199, 399 in both the first and second positions, and may move between the first and second positions while staying inside or protruding outside the frame 99, 199, 399, as long as the detecting unit 200 can detect the moving member 992, 111 in the second position.

Further, the process cartridge 20 does not necessarily include the developing cartridge 40 detachably attached to the drum cartridge 90. The developing cartridge 40 may be integrally formed with the drum cartridge 90.

The above-described embodiment and modifications pertain to the laser printer 1 which is a monochromatic printer. The present invention, however, can be applied to a process cartridge for each of plurality of colors used in a color laser printer.

What is claimed is:

1. A process cartridge comprising:

a frame;

a photosensitive member disposed inside the frame and having a surface;

a charging wire extending in the frame, the charging wire configured to charge the surface of the photosensitive member;

a cleaning member configured to clean the charging wire and that is movable in a moving region between a first position and a second position while sliding on the charging wire; and a moving member that is movable between a third position and a fourth position, wherein a movement of the cleaning member from the first position to the second position moves the moving member in the third position to the fourth position, and the moving member remains in the fourth position when the cleaning member moves from the second position to the first position.

2. The process cartridge according to claim 1, wherein the moving member in the third position is completely within the frame, and the moving member in the fourth position protrudes outside the frame.

3. The process cartridge according to claim 2, wherein the moving member in the fourth position protrudes in a protruding direction to a protruding position, and the frame includes a protecting member defining an opening allowing a detecting operation of a detecting mechanism, the protecting member protruding in the protruding direction at least to the protruding position.

4. The process cartridge according to claim 1, wherein at least a part of the moving member in the third position is in the moving region of the cleaning member such that the cleaning member moved from the first position to the second position abuts and moves the moving member in the third position to the fourth position.

5. The process cartridge according to claim 1, wherein the moving member and the cleaning member are movable in the same direction.

6. The process cartridge according to claim 1, further comprising a regulating member configured to prevent the moving member from moving unless a force greater than a predetermined force is applied on the moving member.

7. The process cartridge according to claim 1, wherein the charging wire extends in a predetermined direction, and the moving member is a rod-like member extending in the predetermined direction.

8. The process cartridge according to claim 1, further comprising a shaft extending in a first direction, wherein:

the charging wire extends in a second direction orthogonal to the first direction; and the moving member is an L-shaped member pivotable about the shaft between the third position and the fourth position, the L-shaped member having a rod member that protrudes in a third direction orthogonal to both the first and second directions to a position outside the frame when the L-shaped member is in the fourth position.

9. An image forming device comprising:

a main casing;

a process cartridge detachably attachable to the main casing; and a detecting mechanism disposed in the main casing, wherein the process cartridge includes:

a frame;

a photosensitive member disposed inside the frame and having a surface;

a charging wire extending in the frame, the charging wire configured to charge the surface of the photosensitive member;

a cleaning member configured to clean the charging wire and that is movable in a moving region between a first position and a second position while sliding on the charging wire; and a moving member that is movable between a third position and a fourth position, wherein a movement of the cleaning member from the first position to the second position moves the moving member in the third position to the fourth position, and the moving member remains in the fourth position when the cleaning member moves from the second position to the first position; and the detecting mechanism detects the moving member in the fourth position in the course of attachment of the process cartridge to the main casing.

10. The image forming device according to claim 9, wherein the moving member in the third position is completely within the frame, and the moving member in the fourth position protrudes outside the frame.

11. The image forming device according to claim 10, wherein the moving member in the fourth position protrudes in a protruding direction to a protruding position, and the frame includes a protecting member defining an opening allowing a detecting operation of the detecting mechanism, the protecting member protruding in the protruding direction at least to the protruding position.

12. The image forming device according to claim 9, wherein the detecting mechanism includes an actuator that is movable and a detecting member that detects the movement of the actuator, and the moving member in the fourth position moves the actuator in the course of attachment of the process cartridge to the main casing.

13. The image forming device according to claim 12, wherein the actuator moves the moving member in the fourth position to the third position in the course of detachment of the process cartridge from the main casing.

14. The image forming device according to claim 13, further comprising a restraining member disposed in the main casing, wherein:

the actuator includes a shaft and a pivot member pivotable about the shaft;

the moving member in the fourth position pivots the pivot member in the course of attachment of the process cartridge; and the restraining member configured to prevent the moving member from pivoting the pivot member in the course of detachment of the process cartridge from the main casing.

15. The image forming device according to claim 14, wherein the process cartridge is configured to be detached from the main casing by being pulled in a detachment direction, and the pivot member has a surface that presses the moving member in the fourth position to the third position in the course of detachment of the process cartridge from the main casing, the surface being diagonal with respect to the detachment direction.

16. The image forming device according to claim 12, further comprising a restraining member disposed in the main casing, wherein:

the process cartridge is attached to the main casing by being inserted in a first direction along an attachment path;

the actuator includes a shaft, a pivot member pivotable about the shaft between a normal position and a pivoted position, and an urging member that urges the pivot member toward the attachment path of the process cartridge; and the pivot member has a first member extending in a radial direction of the shaft and a second member protruding from the first member, the first member abutting the restraining member when the pivot member is in the normal position, the second member having a first surface that extends in a second direction perpendicular to the first direction when the pivot member is in the normal position and a second surface that extends between the first member and the first surface in a third direction that is diagonal with respect to both the first direction and the second direction when the pivot member is in the normal position, the second surface being closer to the attachment path of the process cartridge toward the first surface when the pivot member is in the normal position.

17. The image forming device according to claim 9, wherein the process cartridge is attached to the main casing by being inserted in a first direction, and the moving member is movable in a second direction substantially perpendicular to the first direction.

18. The image forming device according to claim 9, further comprising a regulating member configured to prevent the moving member from moving unless a force greater than a predetermined force is applied on the moving member.

19. The image forming device according to claim 9, wherein at least a part of the moving member in the third position is in the moving region of the cleaning member such that the cleaning member moved from the first position to the second position abuts and moves the moving member in the third position to the fourth position.

* * * * *